US011744778B2

(12) United States Patent
Israeli

(10) Patent No.: US 11,744,778 B2
(45) Date of Patent: Sep. 5, 2023

(54) PILL DISPENSER FOR MEDICATIONS, VITAMINS AND/OR DIETARY SUPPLEMENTS

(71) Applicant: Maori Israeli, Moshavat Kinneret (IL)

(72) Inventor: Maori Israeli, Moshavat Kinneret (IL)

( * ) Notice: Subject to any disclaimer, the term of this patent is extended or adjusted under 35 U.S.C. 154(b) by 117 days.

(21) Appl. No.: 17/312,471

(22) PCT Filed: Dec. 18, 2019

(86) PCT No.: PCT/IB2019/061031
§ 371 (c)(1),
(2) Date: Jun. 10, 2021

(87) PCT Pub. No.: WO2020/128909
PCT Pub. Date: Jun. 25, 2020

(65) Prior Publication Data

US 2022/0047461 A1 Feb. 17, 2022

Related U.S. Application Data

(60) Provisional application No. 62/780,951, filed on Dec. 18, 2018.

(51) Int. Cl.
*A61J 7/00* (2006.01)
*A61J 7/04* (2006.01)
*B65D 83/04* (2006.01)

(52) U.S. Cl.
CPC ..... *A61J 7/0084* (2013.01); *A61J 7/0076* (2013.01); *A61J 7/0436* (2015.05); *B65D 83/04* (2013.01);
(Continued)

(58) Field of Classification Search
CPC ..... A61J 1/03; A61J 7/0076; A61J 7/0084; A61J 7/04; A61J 7/0436; A61J 2200/30;
(Continued)

(56) References Cited

U.S. PATENT DOCUMENTS 1,237,919 A * 8/1917 Linkiewicz ..... G07F 17/14 221/266
2,532,698 A * 12/1950 Corkins ..... G01F 11/24 222/359

(Continued)

FOREIGN PATENT DOCUMENTS

DE 69830219 T2 * 5/2006 ..... B41J 2/1752

OTHER PUBLICATIONS

International Search Report of PCT/IB2019/061031 dated Apr. 23, 2020.

*Primary Examiner* — Rakesh Kumar
(74) *Attorney, Agent, or Firm* — Mark M. Friedman

(57) ABSTRACT

A pill dispenser (10) has a core (12) with outward-facing compartments (14) arranged in rows and layers about a central axis. A first sleeve (22) overlying the core has an elongated slot (24) extending parallel to the central axis, and is rotatable relative to the first sleeve to align the slot with one of the rows of compartments. A second sleeve (26), coaxial with the first sleeve, has a pattern of staggered openings 28 positioned in an axial direction to align with a corresponding one of the layers. The second sleeve is rotatable relative to the first sleeve to bring each of the staggered openings into alignment with the elongated slot, thereby providing access to one of the compartments of the core. Preferably, the core includes a number of axially removable cartridges (30), each including a row of compartments, that can be inserted while the compartments contain pills.

18 Claims, 13 Drawing Sheets

(52) U.S. Cl.
CPC ..... *A61J 2200/30* (2013.01); *A61J 2205/20* (2013.01)

(58) Field of Classification Search
CPC .. A61J 2205/20; B65D 83/0481; B65D 83/04
USPC ..... 221/268, 277
See application file for complete search history.

(56) References Cited

U.S. PATENT DOCUMENTS 2,943,730 A * 7/1960 Tregilgas ..... A61J 7/0076 206/534
3,162,301 A * 12/1964 Cage, Jr. ..... A61J 7/04 206/534
3,606,965 A * 9/1971 Cortelyou et al. ..... A01C 7/06 222/315
3,871,551 A * 3/1975 Bender ..... B65D 83/0409 221/265
4,127,190 A * 11/1978 Sunnen ..... A61J 7/04 206/538
4,245,742 A * 1/1981 Rossmo ..... A61J 7/04 206/533
4,381,059 A * 4/1983 Schurman ..... A61J 7/04 206/533
4,572,376 A * 2/1986 Wrennall ..... A61J 7/04 220/253
4,807,757 A * 2/1989 Rappaport ..... B65D 83/0409 221/133
4,838,453 A * 6/1989 Luckstead ..... A61J 7/0481 221/83
5,104,000 A * 4/1992 Goff ..... B65H 3/02 221/281
5,152,422 A * 10/1992 Springer ..... A61J 7/0409 221/121
5,314,669 A * 5/1994 Hamilton ..... B60H 3/0007 422/123
5,755,357 A * 5/1998 Orkin ..... A61J 7/0084 221/121
5,915,589 A * 6/1999 Lim ..... A61J 7/0481 221/13
5,921,394 A * 7/1999 Shroff ..... B65D 83/0454 206/533
5,979,698 A * 11/1999 Deal ..... A61J 7/04 116/306
7,108,153 B2 * 9/2006 Wood ..... A61J 7/0076 221/152
7,747,347 B2 * 6/2010 Park, IV ..... A61G 12/001 221/121
7,775,205 B2 * 8/2010 Edgerley ..... A61M 15/0066 128/207.14
7,896,192 B2 * 3/2011 Conley ..... G07F 17/0092 221/92
7,909,212 B2 * 3/2011 Parve ..... B65D 83/06 222/548
7,917,246 B2 * 3/2011 Handfield ..... G07F 17/0092 221/124
8,066,123 B2 * 11/2011 Gelardi ..... B65D 83/0445 220/345.2
8,100,303 B2 * 1/2012 Parve ..... B65D 47/0857 220/254.2
8,136,666 B2 * 3/2012 Goldman ..... B65D 83/0454 220/253
8,327,847 B2 * 12/2012 Scarrott ..... A61M 15/0073 128/200.14
8,578,934 B2 * 11/2013 Morton ..... A61M 15/0065 128/205.23
9,150,345 B2 * 10/2015 Thongjitti ..... B65D 83/0016
9,174,775 B2 * 11/2015 Foshee ..... A61J 7/0076
2010/0121274 A1 * 5/2010 Oh ..... A61M 5/148 604/135
2016/0081883 A1 * 3/2016 Saltsov ..... A61J 7/0481 221/122
2016/0120756 A1 * 5/2016 Nazginov ..... A61J 7/04 215/230
2018/0035338 A1 2/2018 Wang et al.
2018/0327174 A1 * 11/2018 Daniels, Jr. ..... B65D 47/265
2020/0390655 A1 * 12/2020 Patel ..... B65D 21/0228
2021/0188523 A1 * 6/2021 Diker ..... B65D 83/0463

* cited by examiner

PILL DISPENSER FOR MEDICATIONS, VITAMINS AND/OR DIETARY SUPPLEMENTS

FIELD AND BACKGROUND OF THE INVENTION

The present invention is a mechanical dispenser for medications, vitamins and/or dietary supplements which, in particularly preferred embodiments, employs interchangeable cartridges. The device assists users in timely administration of their pills, thereby helping to improve or maintain their health.

Various pill dispensers have been proposed. Early examples include those disclosed in U.S. Pat. No. 4,245,742 and in U.S. Pat. No. 4,572,376. Such devices are typically inconvenient to fill or to refill.

SUMMARY OF THE INVENTION

The present invention is a pill dispenser for dispensing medications, vitamins and/or dietary supplements.

According to the teachings of an embodiment of the present invention there is provided, a pill dispenser for dispensing medications, vitamins and/or dietary supplements comprising: (a) a core having a plurality of outward-facing compartments arranged about a central axis, the compartments being arranged in a plurality of rows extending parallel to the central axis, each row being subdivided into a plurality of compartments, each compartment together with corresponding compartments of other rows forming a layer of compartments arrayed around the central axis; (b) a first sleeve overlying the core and coaxial with the core, the first sleeve having an elongated slot extending parallel to the central axis, the core being rotatable relative to the first sleeve so that the elongated slot is aligned selectively with one of the rows of compartments of the core; and (c) a second sleeve coaxial with the first sleeve, the second sleeve having a pattern of staggered openings, each of the staggered openings being positioned in an axial direction to align with a corresponding one of the layers, the second sleeve being rotatable relative to the first sleeve to bring each of the staggered openings selectively into alignment with the elongated slot, thereby providing access to one of the compartments of the core, wherein the core comprises a plurality of axially removable cartridges, each cartridge including at least one of the rows of the compartments, and wherein the removable cartridges can be inserted while the compartments contain pills.

According to a further feature of an embodiment of the present invention, each of the cartridges provides exactly one of the rows of the compartments, and wherein each of the rows of the compartments includes at least 7 compartments.

According to a further feature of an embodiment of the present invention, each of the cartridges spans a sector of the core of between about 90 degrees and about 120 degrees about the central axis.

According to a further feature of an embodiment of the present invention, the core further comprises a support structure, and wherein each of the cartridges has at least one engagement feature for engaging a complementary engagement feature of the support structure.

According to a further feature of an embodiment of the present invention, there is also provided a refill kit comprising a plurality of the cartridges, the compartments of each of the cartridges containing medications, vitamins and/or dietary supplements, and a closure arrangement for retaining the medications, vitamins and/or dietary supplements within the compartments prior to insertion of the cartridges into the pill dispenser.

According to a further feature of an embodiment of the present invention, the refill kit further comprises a tray configured for receiving the plurality of the cartridges of the refill kit, and wherein the closure arrangement includes a lid for the tray.

According to a further feature of an embodiment of the present invention, the closure arrangement of the refill kit comprises a sealing layer of polymer film applied to seal the compartments.

According to a further feature of an embodiment of the present invention, the first sleeve and/or the second sleeve is formed with an end wall having a cartridge-insertion opening, the cartridge-insertion opening being shaped to selectively allow removal and insertion of one of the cartridges with which the cartridge-insertion opening is aligned.

According to a further feature of an embodiment of the present invention, the second sleeve assumes a plurality of distinct positions relative to the first sleeve in which a corresponding one of the staggered openings is in alignment with the elongated slot, and an additional position for filling, and wherein the cartridge-insertion opening is aligned for removal or insertion of one of the cartridges only when the second sleeve assumes the additional position.

According to a further feature of an embodiment of the present invention, the core further comprises a support structure, and wherein each of the plurality of cartridges is color-coded to indicate a corresponding position of insertion relative to the support structure.

According to a further feature of an embodiment of the present invention, the second sleeve further comprises an axial strip without openings such that, when the axial strip is aligned with the elongated slot of the first sleeve, all compartments of the core are closed.

According to a further feature of an embodiment of the present invention, the second sleeve further comprises an axially-extended opening such that, when the axially-extended opening is aligned with the elongated slot of the first sleeve, all compartments of one row of the core are accessible.

According to a further feature of an embodiment of the present invention, there is also provided a cover selectively deployable to cover all openings of the first and second sleeves.

According to a further feature of an embodiment of the present invention, the first sleeve has a radially-visible indicator marking, and wherein the core and the second sleeve each has a radially-visible index surface marked to indicate which row of compartments and which staggered opening is aligned with the elongated slot.

According to a further feature of an embodiment of the present invention, there is also provided a detachable pill box releasably interlocking with the pill dispenser, the detachable pill box having a plurality of manually openable compartments and a pill cutter, the detachable pill box being sized to fit in a user's pocket.

According to a further feature of an embodiment of the present invention, there are also provided electronic components deployed at least partially within a housing integrated with the core.

According to a further feature of an embodiment of the present invention, a number of the compartments in each of the rows is greater than a number of the compartments in each of the layers, and wherein an axial dimension of the pill dispenser is larger than an outer diameter of the pill dispenser.

There is also provided according to an embodiment of the present invention, a pill dispenser for dispensing medications, vitamins and/or dietary supplements comprising: (a) a core having a plurality of outward-facing compartments arranged about a central axis, the compartments being arranged in a plurality of rows extending parallel to the central axis, each row being subdivided into a plurality of compartments, each compartment together with corresponding compartments of other rows forming a layer of compartments arrayed around the central axis; (b) a first sleeve overlying the core and coaxial with the core, the first sleeve having an elongated slot extending parallel to the central axis, the core being rotatable relative to the first sleeve so that the elongated slot is aligned selectively with one of the rows of compartments of the core; and (c) a second sleeve coaxial with the first sleeve, the second sleeve having a pattern of staggered openings, each of the staggered openings being positioned in an axial direction to align with a corresponding one of the layers, the second sleeve being rotatable relative to the first sleeve to bring each of the staggered openings selectively into alignment with the elongated slot, thereby providing access to one of the compartments of the core, wherein a number of the compartments in each of the rows is greater than a number of the compartments in each of the layers, and wherein an axial dimension of the pill dispenser is larger than an outer diameter of the pill dispenser.

BRIEF DESCRIPTION OF THE DRAWINGS

The invention is herein described, by way of example only, with reference to the accompanying drawings, wherein.

DESCRIPTION OF THE PREFERRED EMBODIMENTS

The present invention is a pill dispenser for dispensing medications, vitamins and/or dietary supplements.

The principles and operation of the dispenser according to the present invention may be better understood with reference to the drawings and the accompanying description. The dispenser is applicable to a wide range of applications including prescription and non-prescription medications, vitamins and dietary supplements, in forms ranging from hard tablets through various types of capsules, which may be filled with liquid or solid materials, referred to collectively as "pills". For brevity of description, reference is made below simply to "medications" or "pills", but it should be understood throughout that these terms are used interchangeably with vitamins, dietary supplements, tablets, capsules, and any other products that are suitable for dispensing with the device described herein.

Figure 1:
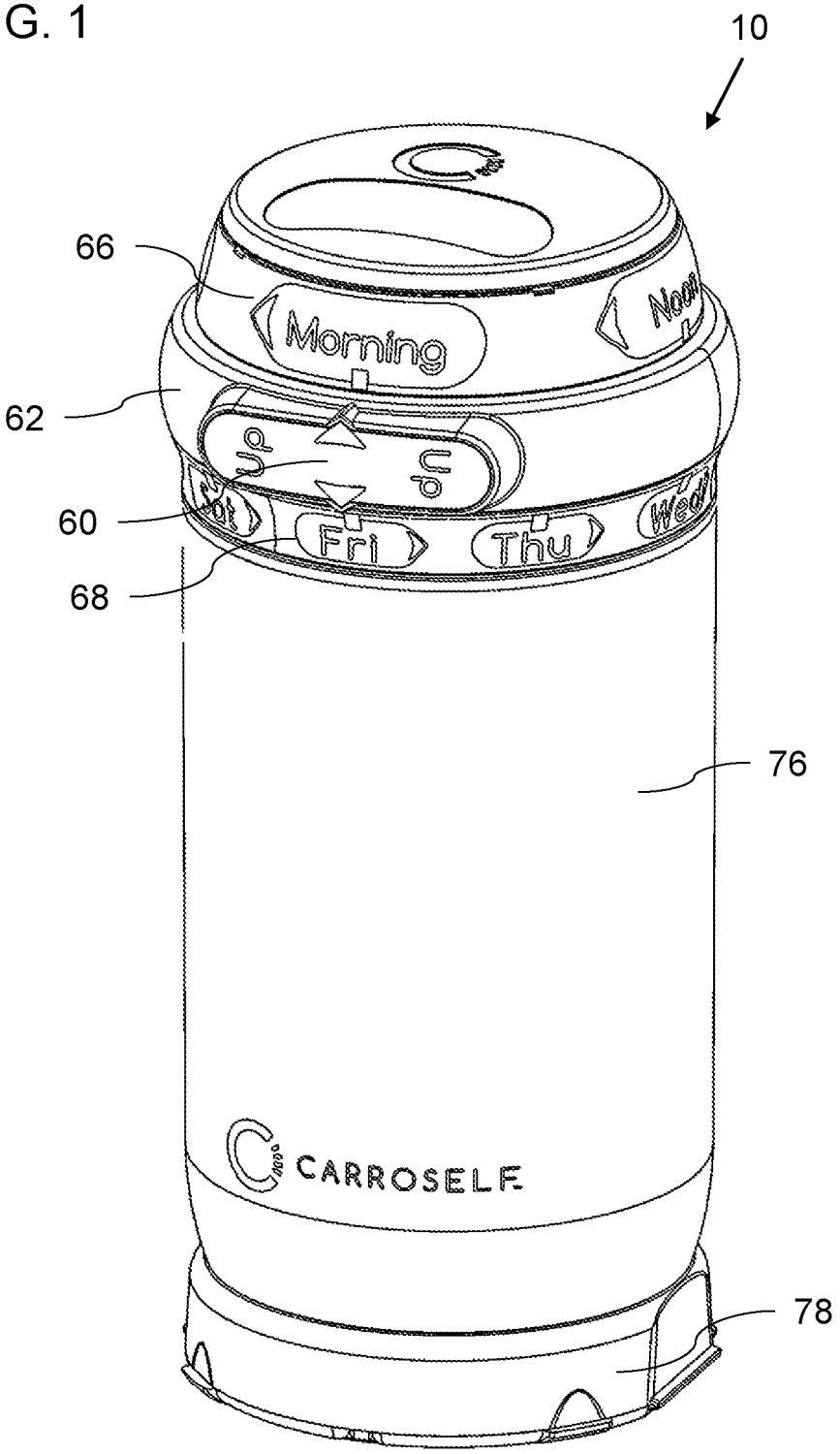
FIG. 1 is an isometric view of a pill dispenser, constructed and operative according to an embodiment of the present invention.
Figure 2:
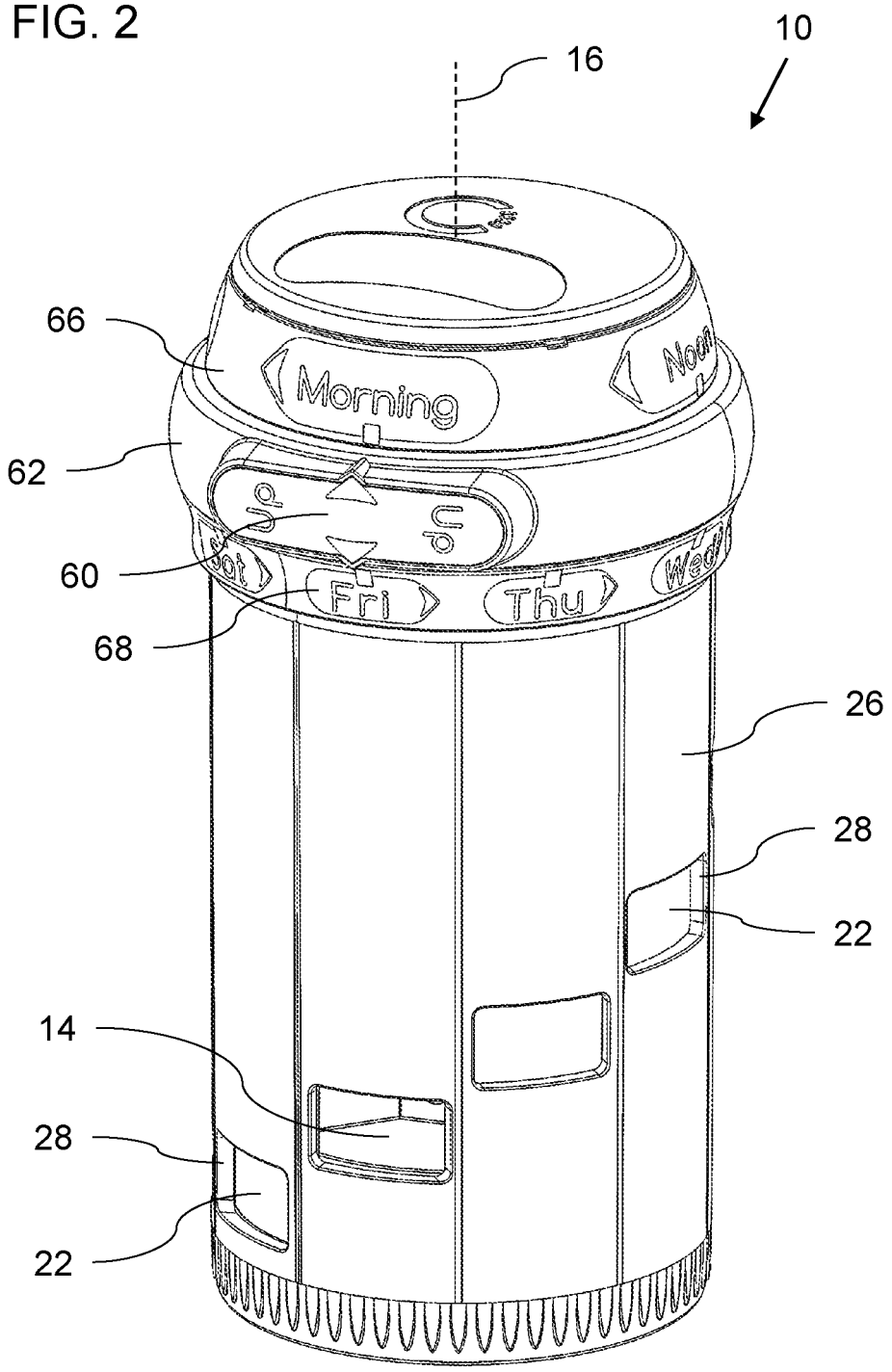
FIG. 2 is an isometric view of the pill dispenser of FIG. 1 with an outer cover removed.
Figure 3A:
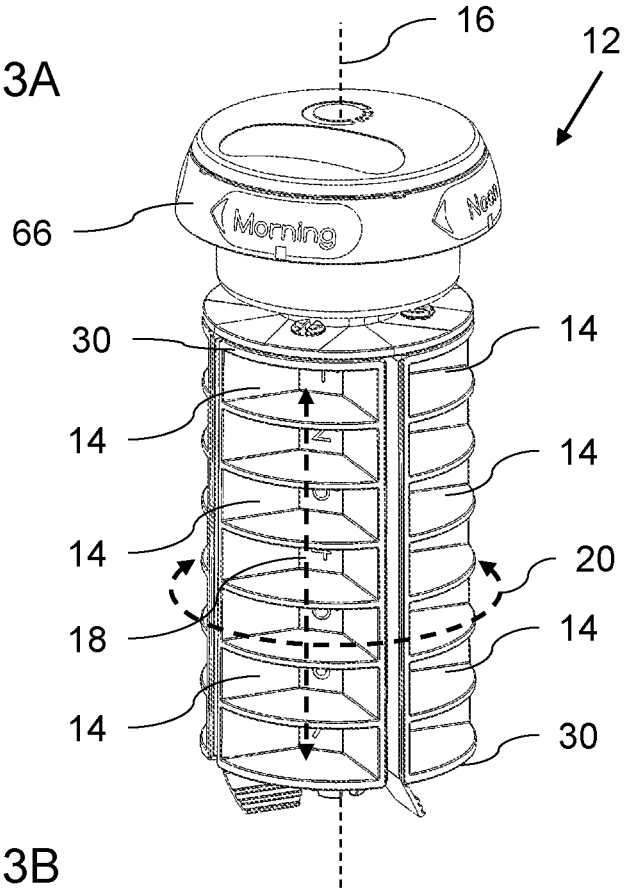
FIGS. 3A-3C are isometric views of a core, a second sleeve and a first sleeve, respectively, from the pill dispenser of FIG. 2.
Figure 3B:
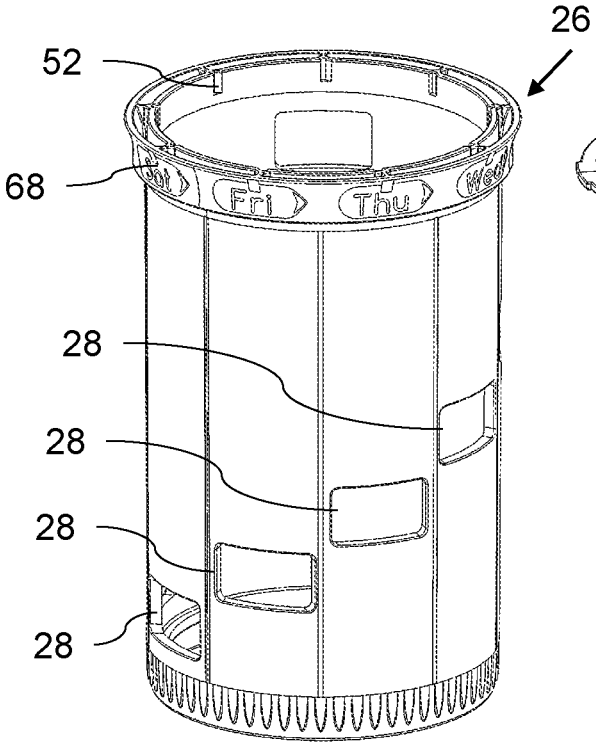
Figure 3C:
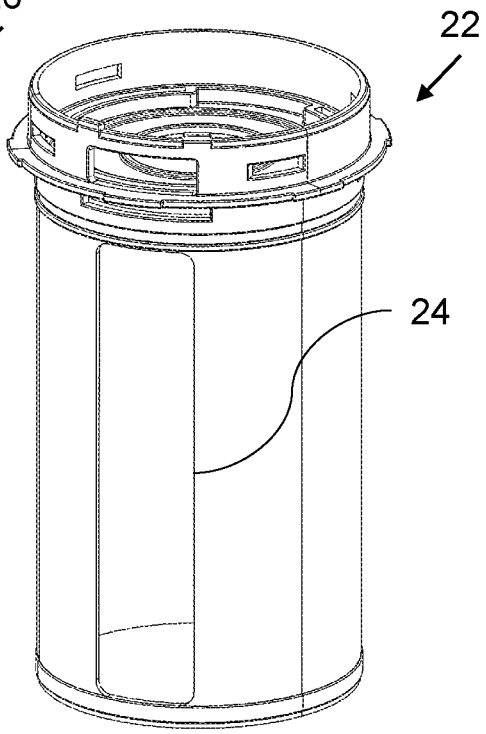

Referring now to the drawings, FIGS. 1-11 and 13A-13C illustrate various aspects of a pill dispenser, generally designated 10, constructed and operative according to the teachings of the present invention, for dispensing medications, vitamins and/or dietary supplements. In general terms, pill dispenser 10 includes a core 12 (FIG. 3A) having a plurality of outward-facing compartments 14 arranged about a central axis 16. Compartments 14 are arranged in a plurality of rows (arrow 18) extending parallel to central axis 16, and each row is subdivided into a plurality of compartments, each compartment together with corresponding compartments of other rows forming a layer of compartments (arrow 20) arrayed around the central axis.

A first sleeve 22 (shown separately in FIG. 3C) overlies core 12. First sleeve 22 has an elongated slot 24 extending parallel to the central axis. Core 12 is rotatable relative to first sleeve 22 so that elongated slot 24 is aligned selectively with one of the rows 18 of compartments of the core. A second sleeve 26 is deployed coaxially with, and in overlapping relation to, first sleeve 22. Second sleeve 26 has a pattern of staggered openings 28, each of which is positioned in an axial direction to align with a corresponding one of the layers 20.

Second sleeve 26 is rotatable relative to first sleeve 22 about central axis 16 to bring each of the staggered openings 28 selectively into alignment with elongated slot 24, thereby providing access to a single one of the compartments 14 of core 12.

Figure 9:
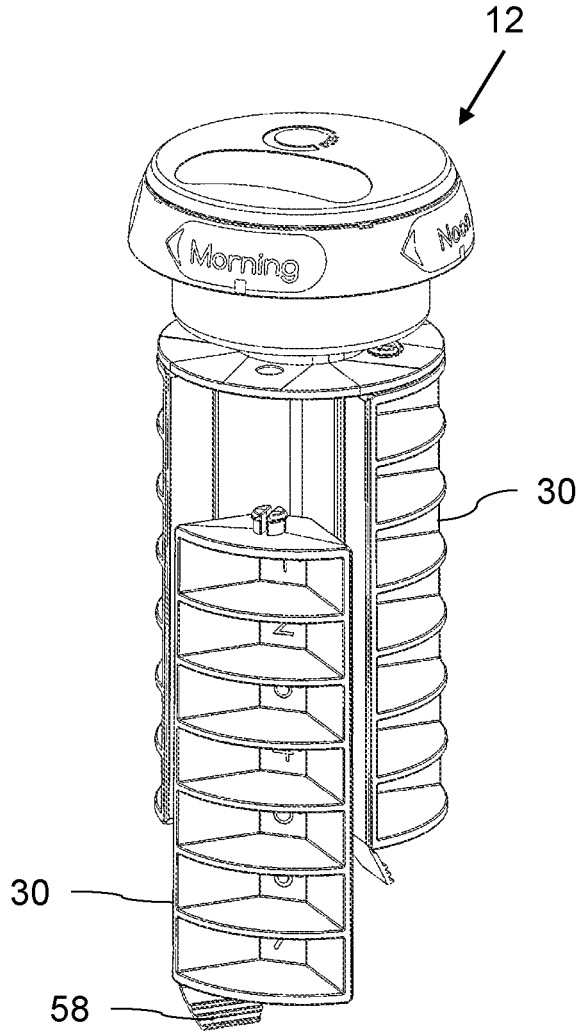
FIG. 9 is an isometric view of the core of the pill dispenser of FIG. 2 illustrating removal or insertion of a removable cartridge.

According to one aspect of certain particularly preferred but non-limiting embodiments of the present invention, core 12 is implemented with a plurality of axially removable cartridges 30, each including at least one row of compartments 14. FIG. 9 illustrates one cartridge 30 being separated from core 12.

Figure 10A:
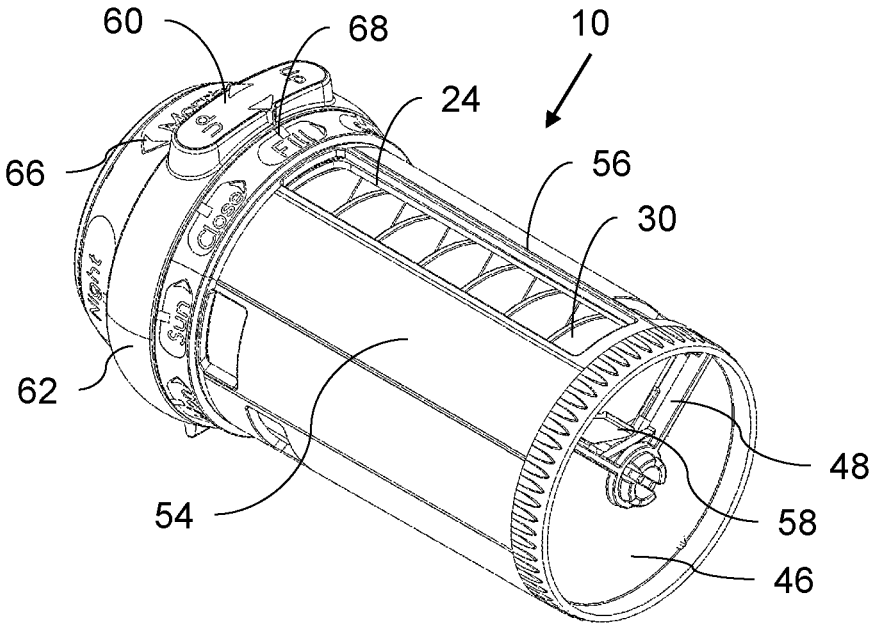
FIGS. 10A-10C are isometric views of the pill dispenser of FIG. 2 in a sequence of positions during removal (or in reverse, replacement) of a cartridge.
Figure 10B:
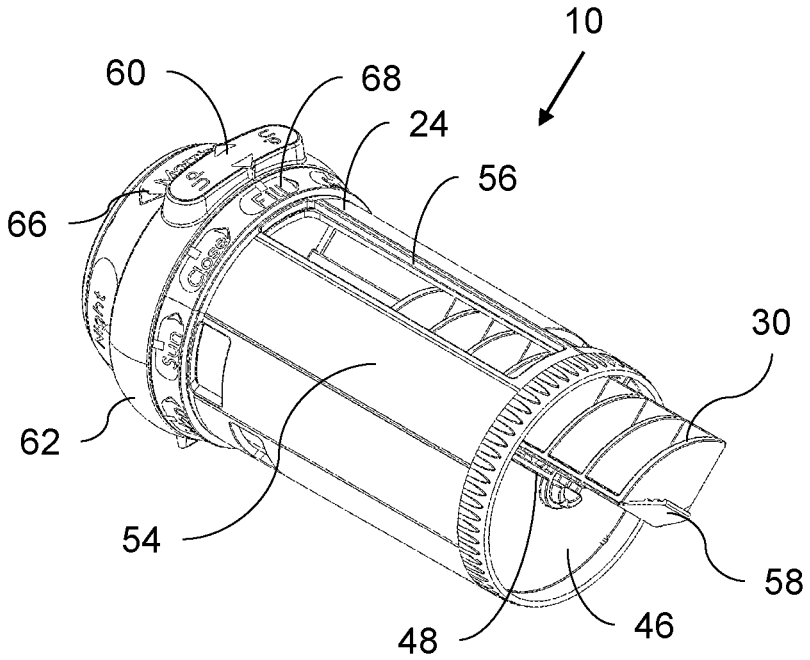
Figure 10C:
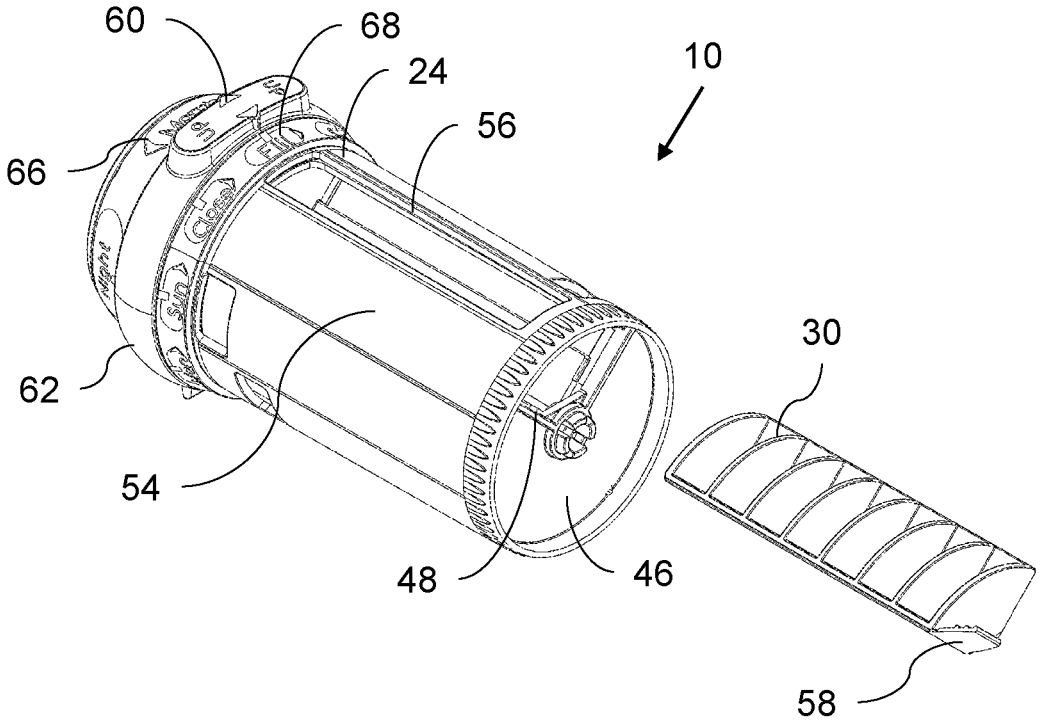
Figure 11:
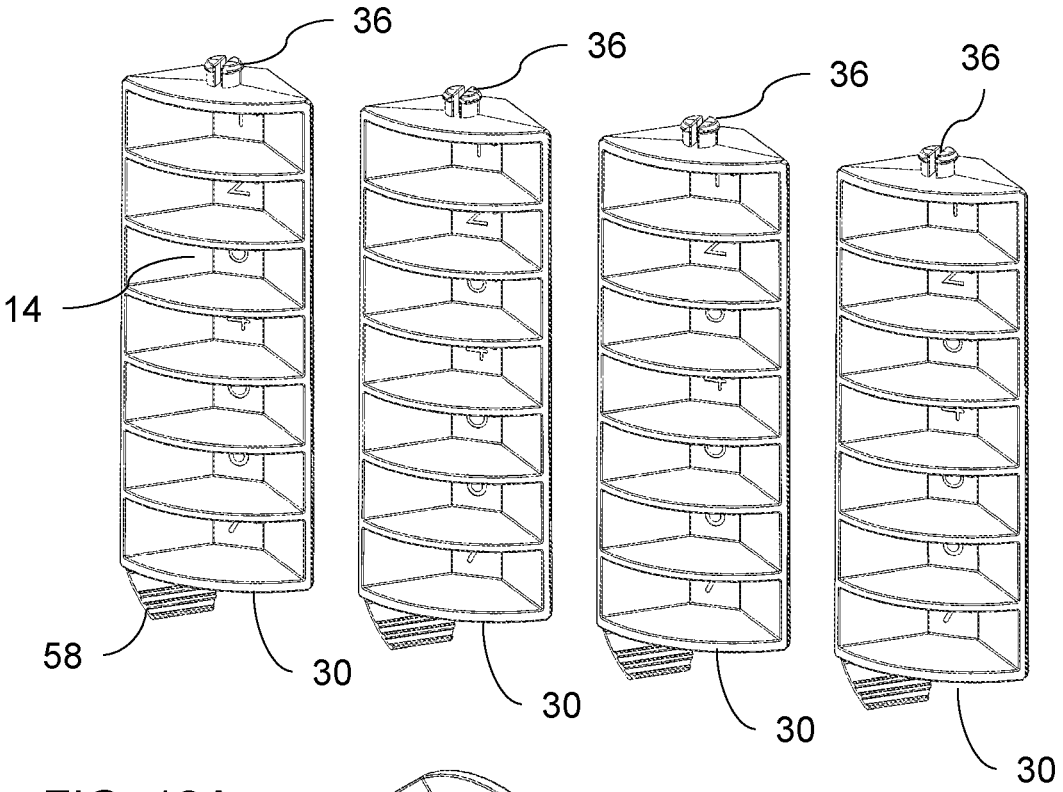
FIG. 11 is an isometric view of a set of replacement cartridges for use in the pill dispenser of FIG. 2.

It is particularly preferred that removable cartridges 30 can be inserted while compartments 14 contain pills, so that the cartridges can be filled with the appropriate dosing regimen of medications, vitamins and/or dietary supplements outside the device and then inserted into the device, rendering the device immediately ready for use. For this purpose, removal and insertion of the cartridges may advantageously be performed while the cartridge is held with the compartments 14 opening upwards, as is illustrated in the sequence of FIGS. 10A-10C.

In the particularly preferred example illustrated here, each cartridge 30 provides exactly one of the rows 18 of compartments 14, and each row of the compartments includes at least 7 compartments. Typically, the number of compartments per cartridge is in the range of 7-10, depending on the intended application as discussed further below, although other numbers of compartments may be suited to alternative applications. Each of the cartridges 30 preferably spans a sector of core 12 corresponding to between about 80 degrees and about 120 degrees about the central axis. This corresponds to either 3 or 4 cartridges which together encompass most of the periphery of the core.

Thus, the particularly preferred implementation as illustrated here provides 7 layers, each subdivided into 4 compartments, where each cartridge 30 is a segment, in this case a quadrant, of core 30, carrying one row of 7 compartments 14, providing one compartment of each layer. The cartridges preferably slide in and out independently from a support structure, which may be a central spindle or holder with one or more feature for receiving each cartridge. Alternatively, in some cases, the cartridges may be implemented so as to interlock directly with each other without a separate support structure (not shown).

Figures 4A, 4B, 4C:
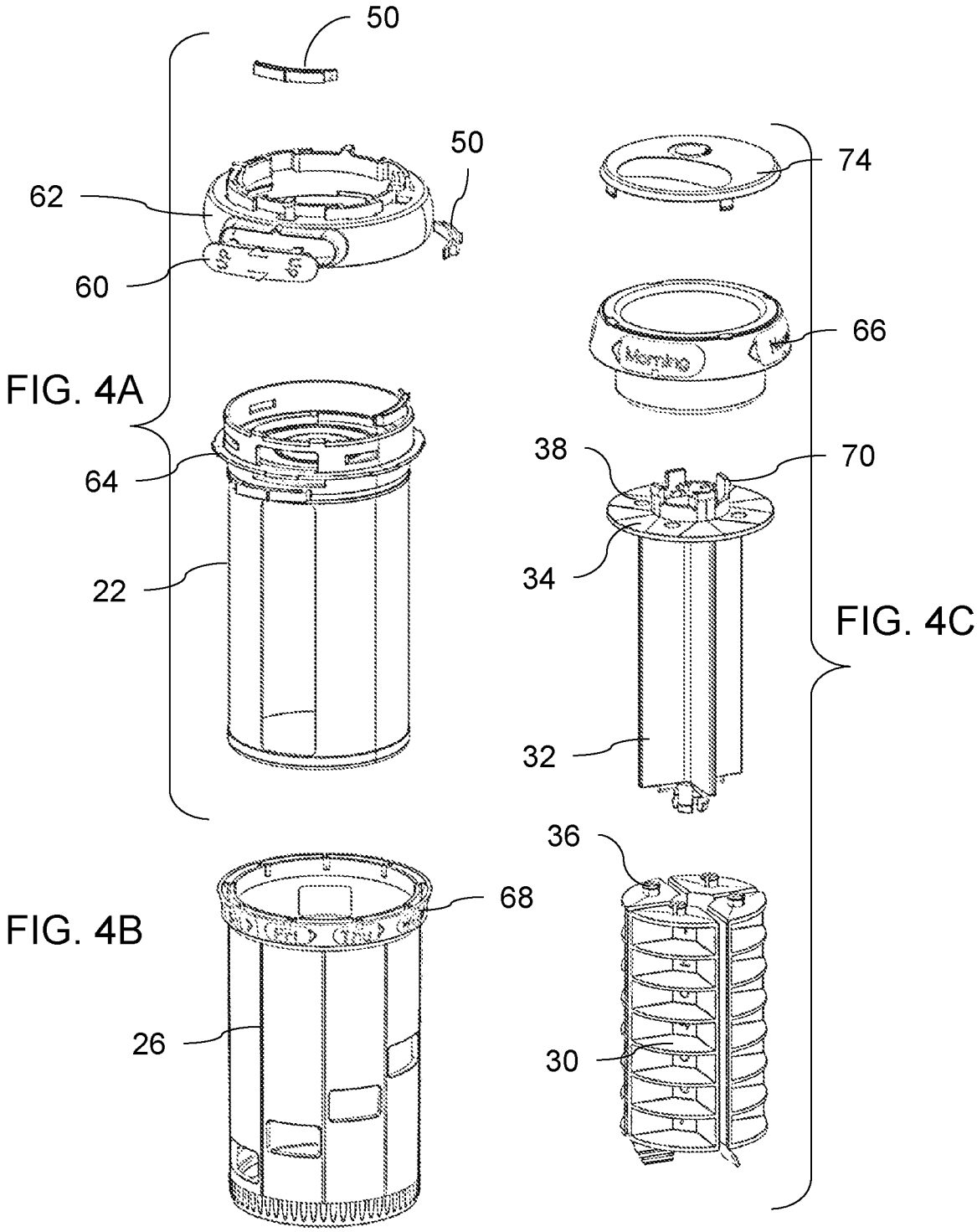
FIGS. 4A-4C are isometric views of the first sleeve, the second sleeve and the core, respectively, from the pill dispenser of FIG. 2, in an axially-exploded view.
Figure 5:
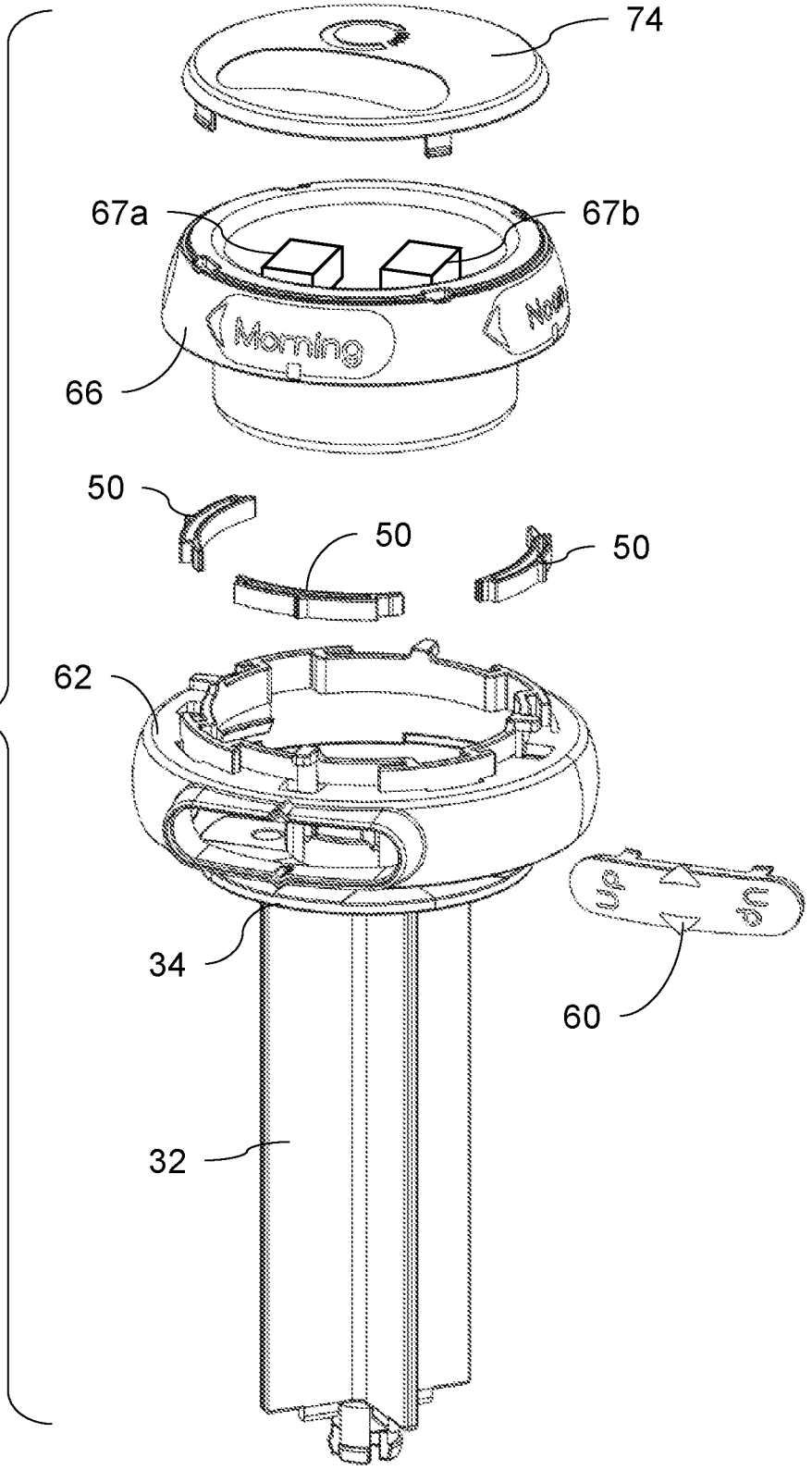
FIG. 5 is an axially-exploded isometric view illustrating a relationship between components of the core and an indicator ring of the first sleeve.

In the example illustrated here, as best seen in FIGS. 4C, 5 and 9, cartridges 30 slide into respective recesses formed between perpendicular surfaces of a support structure 32 which extends along the entire length of the cartridges 30. Support structure 32 also includes a flange 34 which delimits a fully-inserted position of the cartridges.

Preferably, each cartridge 30 and support structure 32 have complementary engagement features for retaining the cartridge in its fully inserted position during use. In the non-limiting example illustrated here, each cartridge is provided with a resilient slotted pin 36 which has a head sized to engage a corresponding aperture 38 in flange 34.

Each cartridge thus has a row of compartments for receiving a sequence of medications, which may correspond, for example, to a daily dosage of medications to be taken once a day or a dosage of medications to be taken at a certain time of the day. The ability to load these cartridges outside the device opens up possibilities of having a "refill kit" prepared, separate from the dispenser that is in use, ready for quickly and easily replenishing the contents of the dispenser. Specifically, a refill kit preferably includes a number of cartridges 30 corresponding to the capacity of the dispenser, where each of the cartridges containing medications, vitamins and/or dietary supplements, typically according to a personalized dosage regimen. A closure arrangement is provided for retaining the medications, vitamins and/or dietary supplements within compartments 14 prior to insertion of the cartridges into the pill dispenser.

Figure 12A:
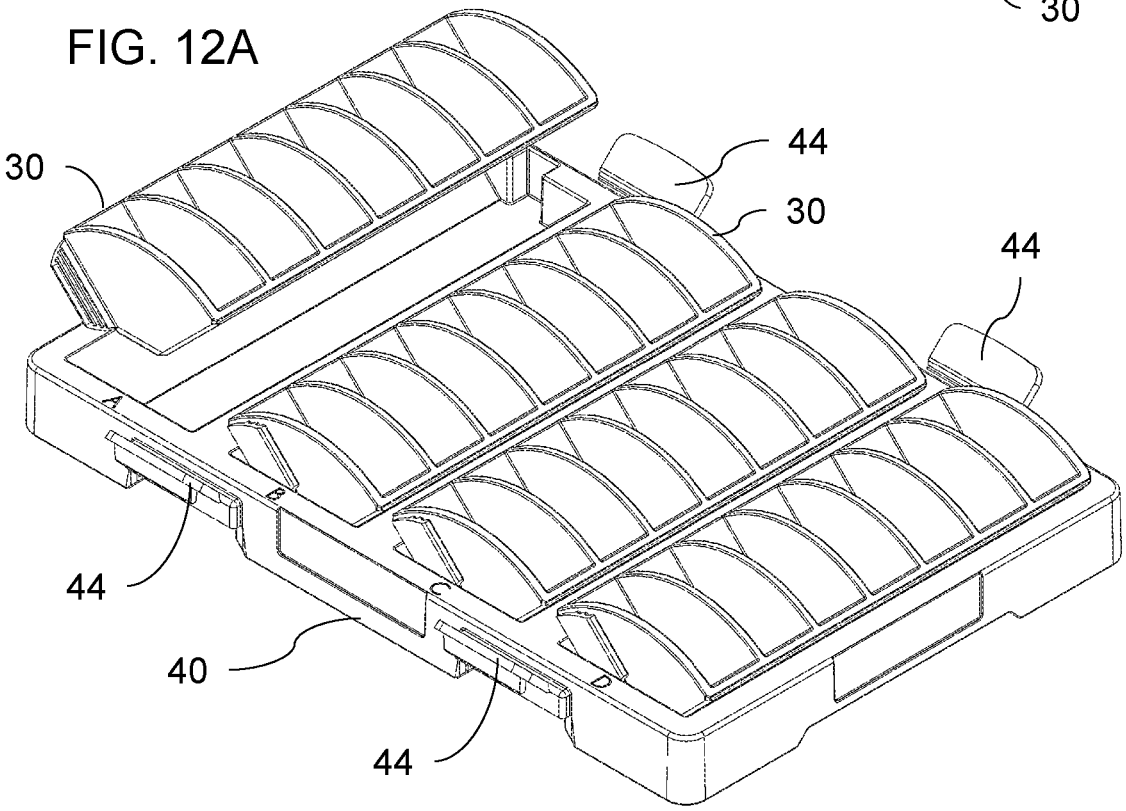
FIG. 12A is an isometric view of a refill kit including the set of replacement cartridges of FIG. 11 housed in a tray.
Figure 12B:
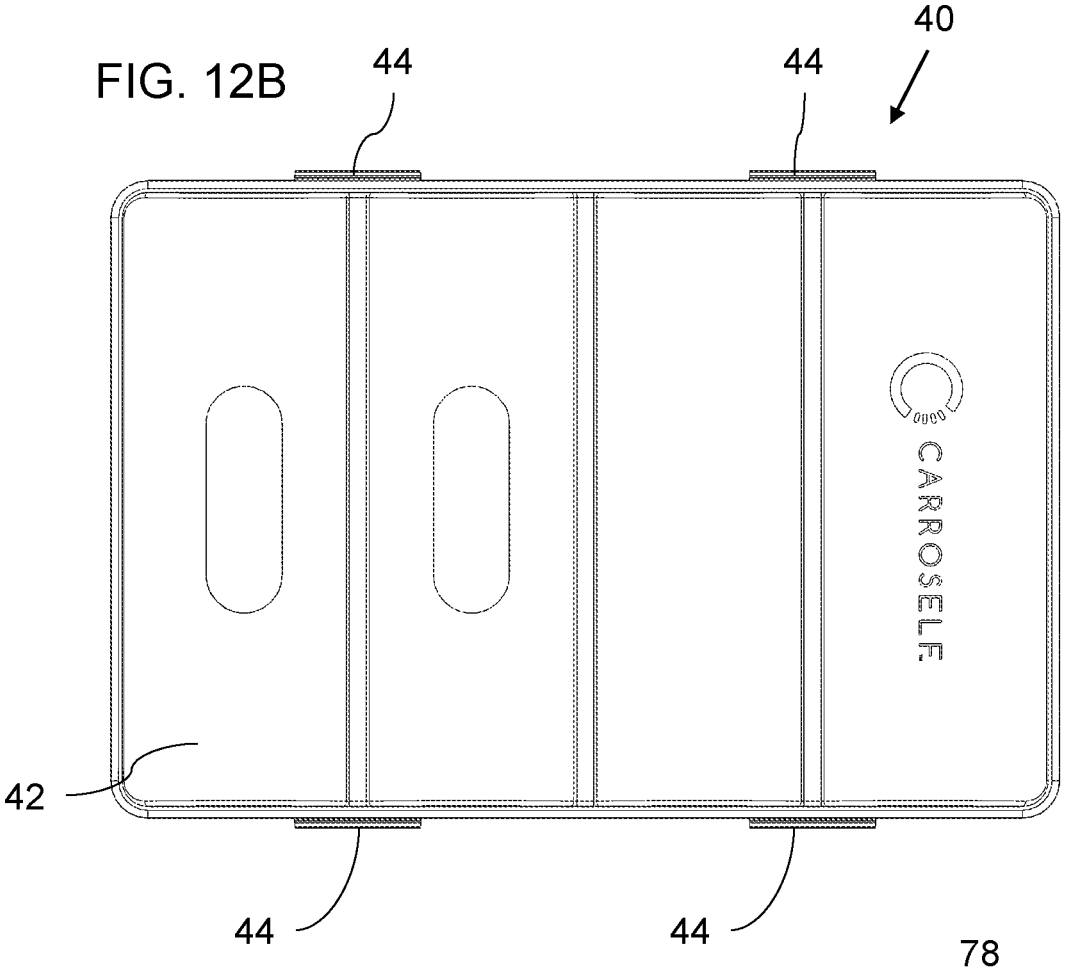
FIG. 12B is a plan view of the tray of FIG. 12A closed by a lid.
Figure 13A:
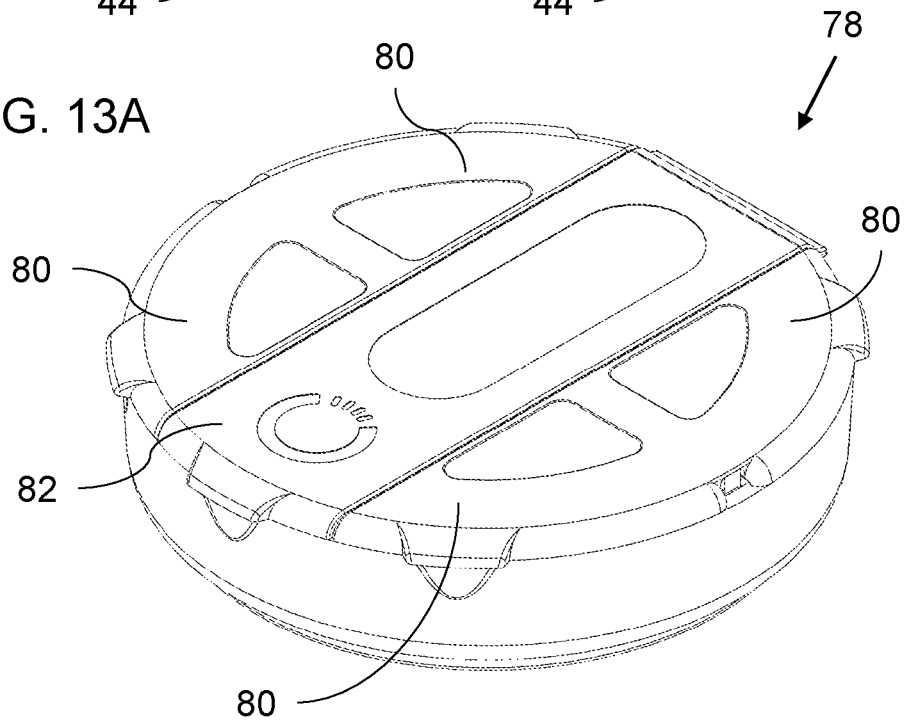
FIG. 13A is an isometric view of a detachable pill box from the pill dispenser of FIG. 1.
Figure 13B:
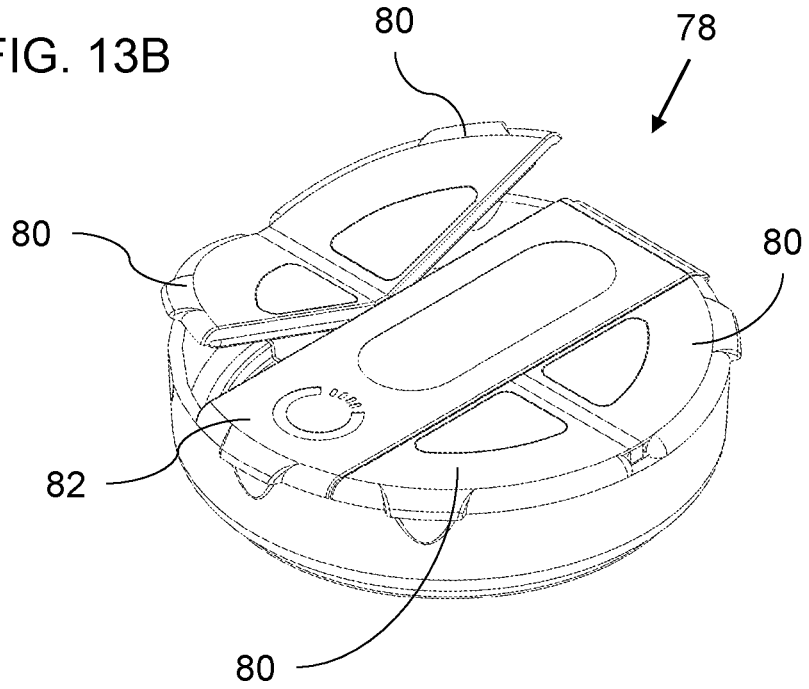
FIG. 13B is an isometric view of the pill box of FIG. 13A illustrating opening of two pill compartments.
Figure 13C:
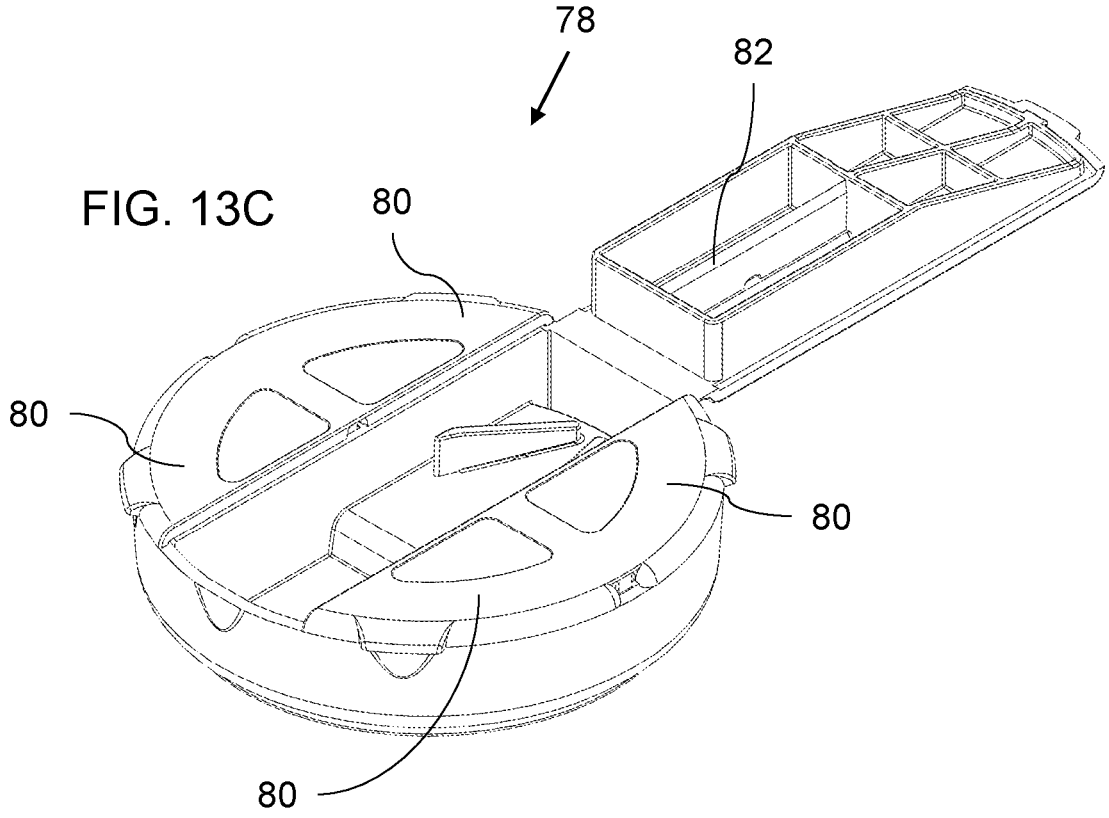
FIG. 13C is an isometric view of the pill box of FIG. 13A illustrating opening of an integrated cutter.

One such example of a refill kit is illustrated in FIGS. 12A and 12B, where a tray 40 is provided that is formed with shaped recesses for receiving and supporting the set of the cartridges 30 of the refill kit. Tray 40 is preferably closed by a suitably shaped lid 42, which is molded to fit closely over the curved surfaces of cartridges 30 and clip firmly into position, for example using clips 44, thereby serving as at least part of the closure arrangement for retaining pills within the compartments 14. This arrangement is particularly useful for allowing the user, or a family member or other caregiver, to sort and arrange pills in the refill kit at their convenience, while the previous set of cartridges are still in use in the dispenser, so that refilling of the dispenser can be performed whenever needed without inconvenience and delay.

Additionally, or alternatively, a refill kit may be provided pre-filled by a medication supplier (pharmacist or other) with specific medications and dosages required for a certain patient preloaded in the correct sequence and quantities. The preloaded cartridges are preferably sealed, such as with a sealing layer of polymer film applied to seal the compartments. The preloaded cartridges may be supplied individually or in a common tray (as shown), to be provided to the user for self-loading of the dispenser. In some cases, prefilling and sealing of the cartridges may be performed automatically by an automated medication dispensing system. The sealing layer may be removed manually by the user (or caregiver) prior to insertion of the cartridge into the dispenser. In certain cases, the cartridge may be inserted without prior removal of a sealing layer. In this case, a cutter (not shown) may optionally be incorporated into the dispenser for removing the sealing layer during insertion, or for rupturing it for each compartment as part of the relative movement of the device components during dispensing.

Thus, a further aspect of an embodiment of the present invention is a method which provides medications according to a personalized dosage regimen preloaded and sealed in cartridges, with multiple compartments per cartridge, where the cartridge is directly loaded into a mechanical dispenser configured to sequentially make available the contents of one compartment at a time. Most preferably, the dispenser accommodates a plurality of the cartridges simultaneously, such as is exemplified by the dispenser described herein.

In order to facilitate correct insertion of the cartridges in corresponding positions within the dispenser, the cartridges are preferably color coded, for example, being formed in their entirety from plastic of colors corresponding to colors indicated on the indicator ring of the device core (as discussed further below), thereby indicating a corresponding required position of insertion relative to the support structure. Additionally, or alternatively, the corresponding positions of the cartridges relative to the core may be indicated by various indicia and/or graphic elements. Additionally, or alternatively, insertion of a cartridge 30 in an incorrect position relative to the support structure of core 12 may be mechanically obstructed, for example by varying the positions of the aforementioned pin-and-aperture engagements between the support structure and the cartridges for each cartridge and its corresponding insertion position, or by providing additional distinct engagement configurations (not shown) for each cartridge and its corresponding position.

Figure 7:
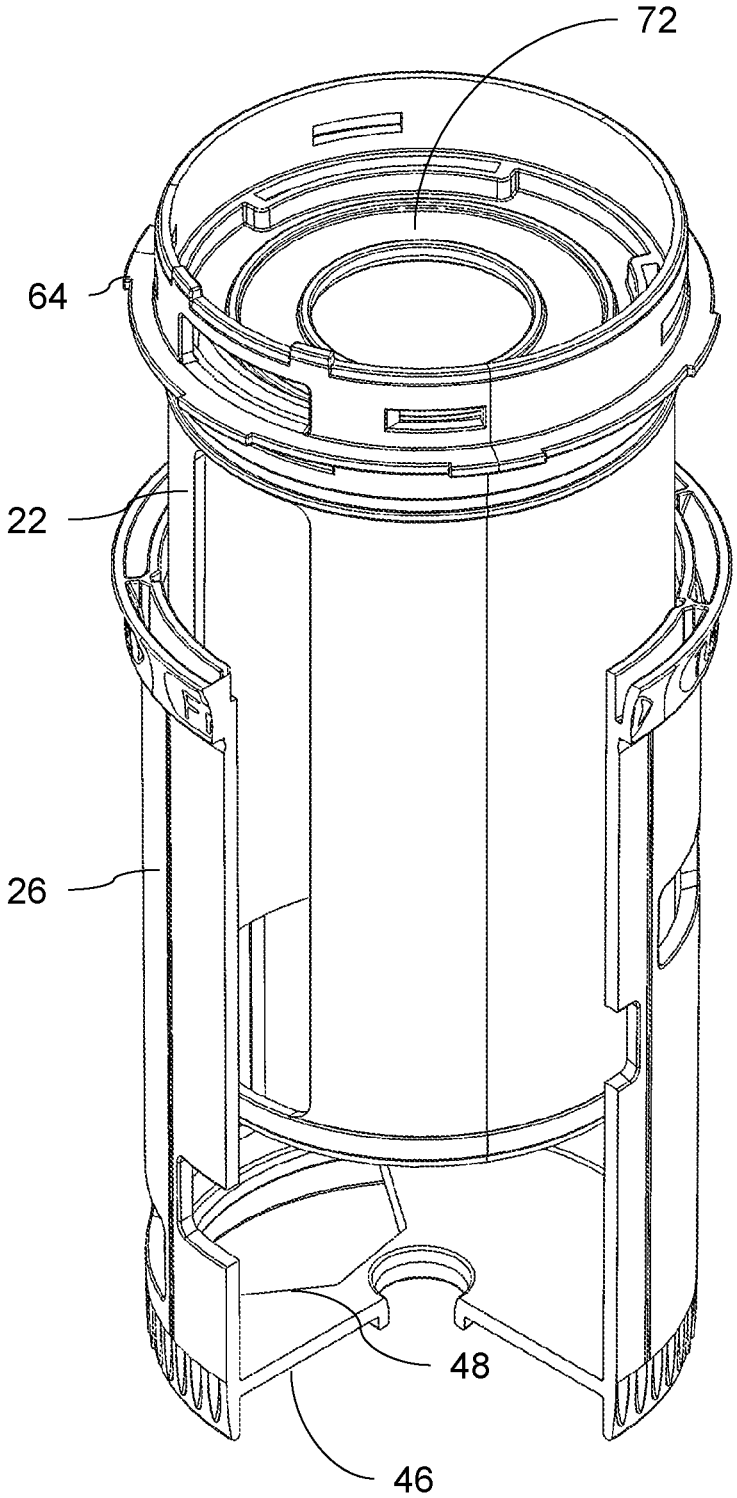
FIG. 7 is a partially cut-away isometric view illustrating the first sleeve partially inserted within the second sleeve.
Figure 8A:
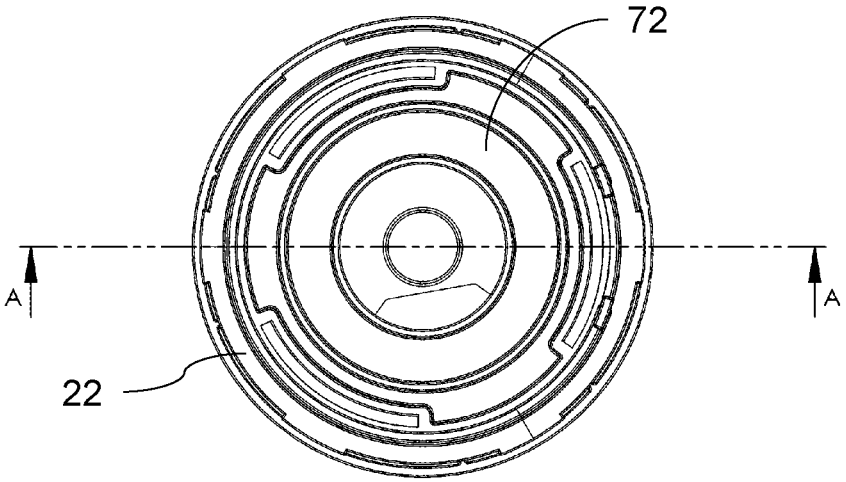
FIG. 8A is a plan view of the first sleeve assembled with the second sleeve.
Figure 8B:
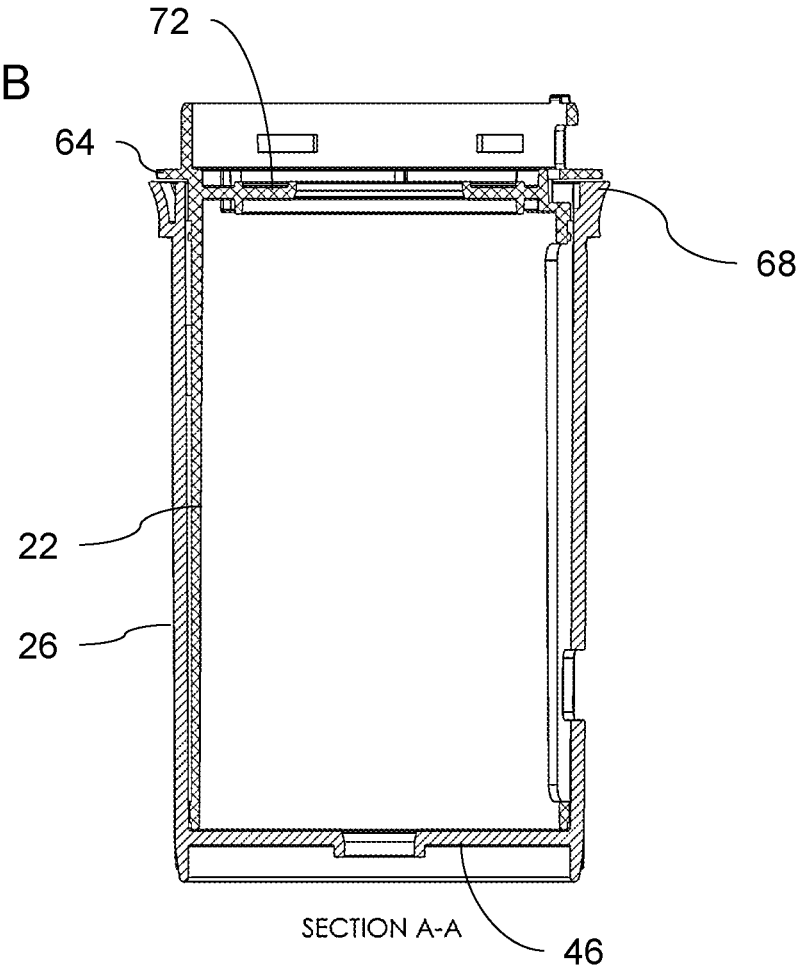
FIG. 8B is a cross-sectional view taken along the line A-A of FIG. 8A.

Turning now to additional structural features relating to the removal and insertion of cartridges 30, in order to provide additional retention of the cartridges within the device during use, one or both of first sleeve 22 and second sleeve 26 is preferably formed with an end wall 46 having a cartridge-insertion opening 48 shaped to selectively allow removal and insertion of one of the cartridges only when the opening is properly aligned with the cartridge (FIGS. 7 and 10A).

Figure 6:
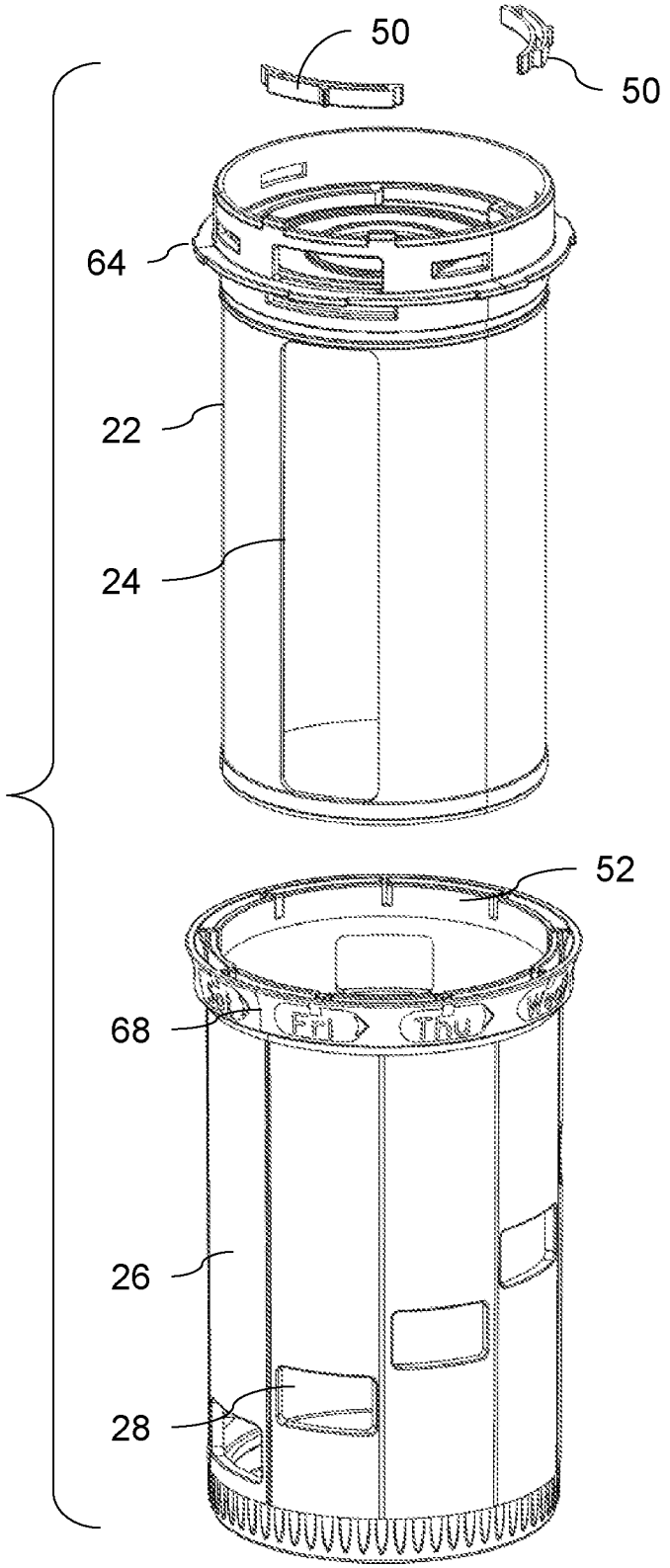
FIG. 6 is an enlarged axially-exploded isometric view illustrating the relationship between the first and second sleeves.

Pill dispenser 10 is preferably provided with a spring-loaded mechanism which defines a number of discrete stopping positions for the relative motion of second sleeve 26 relative to first sleeve 22, and similarly of core 12 relative to first sleeve 22, such that each element is felt to "click into place" relative to each other. Such an effect can be achieved using a wide range of simple mechanical solutions including, but not limited to, spring-loaded bearings, leaf spring elements, and other forms of mechanical engagement. Most preferably, the spring-loaded mechanism also limits the direction of relative rotation to a single direction, acting as a ratchet. One particularly simple implementation to achieve these functions is the use of resilient spring-inserts 50 with a directional ratchet tooth, as seen in FIGS. 4A, 5 and 6, which ride along complementary notches surfaces 52 (FIG. 6) until the tooth becomes engaged in a notch, defining one of the preset positions. Due to the shape of the tooth, the engagement can only be freed by continued rotation in the allowed direction.

In the particularly preferred implementation illustrated here, end wall 46 and cartridge-insertion opening 48 are integrated with second sleeve 26. Most preferably, one of the discrete stopping positions of second sleeve 26 relative to first sleeve 22 is a designated "filling position", distinct from the various dispensing positions in which staggered openings 28 are aligned with elongated slot 24. Where filling is to be performed exclusively by insertion of cartridges which are filled outside the device, the filling position may correspond to alignment with elongated slot 24 of an axial strip 54 of second sleeve 26 without openings (see FIG. 10A), which is in any case preferably present in order to provide a closed state of the device. When the closed axial strip 54 is aligned with elongated slot 24 of first sleeve 22, all compartments of the core are closed.

In order to provide an option for manual filling of the device when the cartridges are inserted (and also for embodiments of the invention which use a fixed core without removable cartridges), second sleeve 26 preferably also includes an axially-extended opening 56 such that, when axially-extended opening 56 is aligned with elongated slot 24 of first sleeve 22, all compartments of one row of the core are accessible, as illustrated in FIG. 10A. In this case, this is preferably also the "filling position" in which cartridge-insertion opening 48 is aligned with whichever of the cartridges 30 is currently aligned with elongated slot 24 to allow removal and insertion of the cartridge.

In order to facilitate removal of the cartridges, each cartridge is preferably provided with a resilient pull-tab 58 which is manually accessible via cartridge-insertion opening 48 when the cartridge is aligned with the opening.

In the particularly preferred implementation illustrated herein, core 12 has 4 compartments per layer, and therefore 4 indexing positions relative to first sleeve 22. Second sleeve 26 has 7 staggered openings 28 corresponding to the 7 layers of the core, plus closed strip 54 and axially-extended opening 56, making a total of 9 indexed positions relative to first sleeve 22. Since 4 and 9 are coprime, none of the positions of second sleeve 26 other than the designated filling position will have the cartridge-insertion opening correctly aligned with any of the cartridges, thereby ensuring that a cartridge cannot be removed except when the device is in the filling position.

In certain particularly preferred implementations, for example as illustrated herein, the status of the device defined by relative positions of the core, the first sleeve and the second sleeve, are readily visible from the radially-outward surface of the dispenser. In this case, first sleeve 22 has a radially-visible indicator marking 60, which is here incorporated into a ring 62 which mounts on an outwardly projecting flange 64 associated with first sleeve 22 (FIG. 4A). Core 12 and second sleeve 26 each has a radially-visible index surface, 66 and 68, respectively, marked to indicate which row of compartments and which staggered opening is currently aligned with the elongated slot. In the implementation illustrate here, index surface 68 can be simply implemented along the upper edge of second sleeve 26 and outwards of slotted surface 52. In the case of core 12, radially-visible index surface 66 is implemented as part of a hollow housing which snap-fits onto a set of resilient tabs 70 (FIG. 4C) which project through a central opening in a top end surface 72 of first sleeve 22. By providing an additional snap-fit engagement at the bottom of support structure 32 which engages a complementary aperture in base 46 of second sleeve 26, the core assembly essentially links together all parts of the device once assembled.

Pill dispenser 10 is preferably provided with a cover 76, selectively deployable to cover all openings of the first and second sleeves. Outer cover 76 is preferably provided in the form of a cylindrical sleeve, typically closed at one end, which serves to provide physical protection for the dispenser when not in use, as well as protection of the medications from UV radiation, and serves to prevent inadvertent release of medications and/or ingress of dirt or foreign bodies into the device when not in use. When used in combination with the "closed" state of the inner-outer casings, the device provides a double closure arrangement to protect the contents of the dispenser, even under challenging conditions of motion and vibration. The outer cover also provides surfaces for images and/or writing, which may be advertising material, patient details and/or decorative content.

According to certain particularly preferred implementations, pill dispenser 10 further comprises a detachable pill box 78, releasably interlocking with the pill dispenser 10. In the preferred example illustrated in FIG. 1, detachable pill box 78 is shaped to snap-fit to a lower rim of cover 76 so as to function as a base for the dispenser during normal use, and to be manually detachable when needed. Pill box 78 preferably has a plurality of manually openable compartments 80, typically four corresponding to the number of compartments per layer of the dispenser, thereby allowing the user to transfer a day's worth of doses to the pill box 78. The particularly preferred pill box as illustrated here also includes an integrated pill cutter 82, allowing the user to divide pills whenever needed. Detachable pill box 78 is preferably sized to fit conveniently in a user's pocket, preferably defined as having overall dimensions of no more than 2×10×10 cm. The detachable pill box is particularly convenient for short term use in cases where the user will be highly mobile and prefers not to carry the pill dispenser.

Notwithstanding the above, it is noted that the form factor of pill dispenser 10 is significantly more compact than most devices with similar capacity. Specifically, as per the examples given above, the number of compartments 14 in each row (typically 7 or 10) is greater than a number of compartments in each of layer (typically 3 or 4). As a result of this differential, and additional aspects of the preferred configuration, an axial dimension of pill dispenser 10 is typically larger than an outer diameter of the pill dispenser. The small diameter renders the device convenient for handling, typically easily gripped by fingers of the user reaching opposite sides of the device, and fitting conveniently into a briefcase or backpack occupying a space similar to a small vacuum flask.

In use, where the open axial row of the outer casing is brought into alignment with the open axial row of the inner casing, an entire row of the central core is exposed. This is useful for manual loading of pills into the compartments of the central core, or emptying therefrom. However, if the intended mode of use of the device is exclusively through insertion of pre-loaded cartridges, an implementation of the invention without the open row in the outer casing may be preferred.

Where the closed row of the outer casing is brought into overlapping relation to the open row of the inner casing, all apertures of each casing are closed, and all of the medicament compartments remain closed.

When one of the staggered openings of the outer casing is brought into alignment with the open row of the inner casing, this results in selective opening of exactly one compartment of the central core, thereby allowing dispensing of the contents of that compartment into the hand of the user. By rotating the central core in this state, each successive compartment of the selected layer is brought into alignment with the aligned openings of the inner and outer casings, thereby allowing dispensing of the contents of that compartment.

The device may be used in a number of different modes. In the typical case of 7 layers of 4 compartments, the outer casing may be rotated by one column/step per day to select a layer (from 1-7) corresponding to a day of the week, and the core may be turned to select a corresponding period of the day, such as morning, midday, evening and night, thereby dispensing medications four times a day for a week. Alternatively, the core may be left in place relative to the inner casing for a week at a time, become a week selector. In this case, the dispenser becomes a 1×28 dispenser, suitable for dispensing medication once a day for 4 consecutive weeks, or 28 days. Most preferably, the aforementioned index surfaces 66 and 68 are labeled with appropriate labels for the intended application, for example, day names, e.g., Sunday, Monday, Tuesday etc. through Saturday on index surface 68, while index surface 66 is marked (Morning, Lunchtime, Evening, Night) or (Week 1, Week 2, Week 3, Week 4), according to the intended usage. The labels aligned with indicator 60 also serve as a visual reminder to the user as to when the last dosage was taken. Thus, if the user doesn't remember whether she took her midday dose, she can look at the dispenser to check whether the opening (last dose taken) is still set to the morning, or whether the midday dose was already dispensed.

Clearly other modes of use are also possible, such as twice-a-day for two weeks. According to one preferred implementation, the marking locations are implemented as sockets for receiving pre-labeled inserts, or as recessed panels for receiving pre-labeled stickers, to identify the corresponding time periods according to various options for use.

As mentioned above, the device is not limited to implementations with specifically 7 layers and 4 compartments per layer. For example, in an alternative implementation, the device is implemented with three compartments per layer, and/or ten layers, allowing administration of medicaments 3×7 or 3×10 (as is typical for some courses of antibiotics, or 1×30 for a 30-day month.

Most preferably, both the first sleeve 22 ("inner casing") and the second sleeve 26 ("outer casing") are made from material which is at least partially transparent, allowing the user to verify visually whether there are medicaments in a given (currently closed) compartment, and/or to visually verify correct alignment of the central core or to see color coding of the core segments/cartridges. Particularly for use in multiple daily doses, intuitive color coding of the cartridges making up the central core (or segments of the core in a case of a fixed core structure) is preferably used. By way of one non-limiting example, coding may include:

White for morning;
Yellow for lunchtime;
Blue for evening;
Black for night.

Optionally, hollow housing 66 may include an internal volume which houses one or more battery, preferably rechargeable, powering various electronic components, to provide additional functionality to the medication dispenser. The electronic components may include various sensors 67*a* for sensing the mechanical state of the device, and Bluetooth (communication) components 67*b* for communicating with a mobile phone or the like and/or GPS components, preferably operating a dedicated mobile APP which provides additional functionality, such as monitoring whether the device has been opened for taking the required dose at the required time, to facilitate locating of the device if misplaced and/or notifications to the mobile phone from the device according to a preprogrammed schedule. Additionally, or alternatively, a built-in clock with audio and/or indicator light timer reminders may be provided to prompt taking of medications. A removable cover 74 may be provided for concealing components that are not intended to be visible during use.

Optionally, the electronic components may also include a small motorized drive for advancing the components to the correct positions for the next medication dosage to be released. Such motorized operation may be triggered by a manual input, or may occur automatically at the programmed time.

To the extent that the appended claims have been drafted without multiple dependencies, this has been done only to accommodate formal requirements in jurisdictions which do not allow such multiple dependencies. It should be noted that all possible combinations of features which would be implied by rendering the claims multiply dependent are explicitly envisaged and should be considered part of the invention.

It will be appreciated that the above descriptions are intended only to serve as examples, and that many other embodiments are possible within the scope of the present invention as defined in the appended claims.

What is claimed is:

1. A pill dispenser for dispensing medications, vitamins and/or dietary supplements comprising:

(a) a core having a plurality of outward-facing compartments arranged about a central axis, said compartments being arranged in a plurality of rows extending parallel to said central axis, each row being subdivided into a plurality of compartments, each compartment together with corresponding compartments of other rows forming a layer of compartments arrayed around the central axis, such that said core has a plurality of layers;

(b) a first sleeve overlying said core and coaxial with said core, said first sleeve having an elongated slot extending parallel to said central axis, said core being rotatable relative to said first sleeve so that said elongated slot is aligned selectively with one of said rows of compartments of said core; and (c) a second sleeve coaxial with said first sleeve, said second sleeve having a pattern of staggered openings, each of said staggered openings being positioned in an axial direction to align with a corresponding one of said layers, said second sleeve being rotatable relative to said first sleeve to bring each of said staggered openings selectively into alignment with said elongated slot, thereby providing access to one of said compartments of said core, wherein said core comprises a plurality of axially removable cartridges, each cartridge including at least one of said rows of said compartments, and wherein said removable cartridges can be inserted while said compartments contain pills.

2. The pill dispenser of claim 1, wherein each of said cartridges provides exactly one of said rows of said compartments, and wherein each of said rows of said compartments includes at least 7 compartments.

3. The pill dispenser of claim 1, wherein each of said cartridges spans a sector of said core of between about 90 degrees and about 120 degrees about said central axis.

4. The pill dispenser of claim 1, wherein said core further comprises a support structure, and wherein each of said cartridges has at least one engagement feature for engaging a complementary engagement feature of said support structure.

5. The pill dispenser of claim 1, further comprising a refill kit comprising a plurality of said cartridges, said compartments of each of said cartridges containing medications, vitamins and/or dietary supplements, and a closure arrangement for retaining said medications, vitamins and/or dietary supplements within said compartments prior to insertion of said cartridges into the pill dispenser.

6. The pill dispenser of claim 5, wherein said refill kit further comprises a tray configured for receiving said plurality of said cartridges of said refill kit, and wherein said closure arrangement includes a lid for said tray.

7. The pill dispenser of claim 5, wherein said closure arrangement comprises a sealing layer of polymer film applied to seal said compartments.

8. The pill dispenser of claim 1, wherein said first sleeve and/or said second sleeve is formed with an end wall having a cartridge-insertion opening, said cartridge-insertion opening being shaped to selectively allow removal and insertion of one of said cartridges with which said cartridge-insertion opening is aligned.

9. The pill dispenser of claim 8, wherein said second sleeve assumes a plurality of distinct positions relative to said first sleeve in which a corresponding one of said staggered openings is in alignment with said elongated slot, and an additional position for filling, and wherein said cartridge-insertion opening is aligned for removal or insertion of one of said cartridges only when said second sleeve assumes said additional position.

10. The pill dispenser of claim 1, wherein said core further comprises a support structure, and wherein each of said plurality of cartridges is color-coded to indicate a corresponding position of insertion relative to said support structure.

11. The pill dispenser of claim 1, wherein said second sleeve further comprises an axial strip without openings such that, when said axial strip is aligned with said elongated slot of said first sleeve, all compartments of said core are closed.

12. The pill dispenser of claim 1, wherein said second sleeve further comprises an axially-extended opening such that, when said axially-extended opening is aligned with said elongated slot of said first sleeve, all compartments of one row of said core are accessible.

13. The pill dispenser of claim 1, further comprising a cover selectively deployable to cover all openings of said first and second sleeves.

14. The pill dispenser of claim 1, wherein said first sleeve has a radially-visible indicator marking, and wherein said core and said second sleeve each has a radially-visible index surface marked to indicate which row of compartments and which staggered opening is aligned with said elongated slot.

15. The pill dispenser of claim 1, further comprising a detachable pill box releasably interlocking with said pill dispenser, said detachable pill box having a plurality of manually openable compartments and a pill cutter, said detachable pill box being sized to fit in a user's pocket.

16. The pill dispenser of claim 1, further comprising electronic components deployed at least partially within a housing integrated with said core, said electronic components comprising communication components and sensors for sensing a mechanical state of the pill dispenser, for monitoring whether the pill dispenser has been opened for taking a required dose at a required time.

17. The pill dispenser of claim 1, wherein a number of said compartments in each of said rows is greater than a number of said compartments in each of said layers, and wherein an axial dimension of the pill dispenser is larger than an outer diameter of the pill dispenser.

18. A pill dispenser for dispensing medications, vitamins and/or dietary supplements comprising:

(a) a core having a plurality of outward-facing compartments arranged about a central axis, said compartments being arranged in a plurality of rows extending parallel to said central axis, each row being subdivided into a plurality of compartments, each compartment together with corresponding compartments of other rows forming a layer of compartments arrayed around the central axis, such that said core has a plurality of layers;

(b) a first sleeve overlying said core and coaxial with said core, said first sleeve having an elongated slot extending parallel to said central axis, said core being rotatable relative to said first sleeve so that said elongated slot is aligned selectively with one of said rows of compartments of said core; and (c) a second sleeve coaxial with said first sleeve, said second sleeve having a pattern of staggered openings, each of said staggered openings being positioned in an axial direction to align with a corresponding one of said layers, said second sleeve being rotatable relative to said first sleeve to bring each of said staggered openings selectively into alignment with said elongated slot, thereby providing access to one of said compartments of said core, wherein a number of said compartments in each of said rows is greater than a number of said compartments in each of said layers, and wherein an axial dimension of the pill dispenser is larger than an outer diameter of the pill dispenser.

* * * * *